US007676932B2

(12) United States Patent
Grice

(10) Patent No.: US 7,676,932 B2
(45) Date of Patent: Mar. 16, 2010

(54) KNIFE WITH SPRING-ASSISTED BLADE ARTICULATION MECHANISM

(76) Inventor: Jerry L. Grice, Crawfordville, FL (US); Tycelia Grice, legal representative, 57 Summerwind Cir., South, Crawfordville, FL (US) 32327

( * ) Notice: Subject to any disclaimer, the term of this patent is extended or adjusted under 35 U.S.C. 154(b) by 643 days.

(21) Appl. No.: 11/365,717

(22) Filed: Mar. 1, 2006

(65) Prior Publication Data

US 2006/0150422 A1 Jul. 13, 2006

Related U.S. Application Data

(63) Continuation-in-part of application No. 10/745,793, filed on Dec. 29, 2003, now abandoned.

(51) Int. Cl.
*B26B 1/04* (2006.01)

(52) U.S. Cl. ..... 30/160; 30/153; 30/155; 30/159

(58) Field of Classification Search ..... 30/153, 30/155–161; 7/118, 900
See application file for complete search history.

(56) References Cited

U.S. PATENT DOCUMENTS 592,612 A * 10/1897 Johnson ..... 30/159
2,197,136 A * 4/1940 Wallace et al. ..... 30/159
6,145,202 A * 11/2000 Onion ..... 30/160
6,308,420 B1 * 10/2001 Moser ..... 30/161
6,651,344 B2 * 11/2003 Cheng ..... 30/159
6,810,588 B1 * 11/2004 Cheng ..... 30/153
7,146,736 B1 * 12/2006 Collins ..... 30/160
2001/0023541 A1 * 9/2001 Blanchard ..... 30/161
2005/0072004 A1 * 4/2005 Carter ..... 30/158

* cited by examiner

*Primary Examiner*—Phong H Nguyen
(74) *Attorney, Agent, or Firm*—J. Wiley Horton

(57) ABSTRACT

A knife with a spring-assisted articulation mechanism for assisting the user in the folding and unfolding of the blade from the pocket of the liner. The spring-assisted articulation mechanism also helps retain the blade in the folded position to prevent the blade from becoming unintentionally unfolded. The knife includes a pocketed liner and a blade attached to liner at one end of the liner by a pivot pin. The blade has a pointed end and a base end, the base end pivotally secured to the second end of the liner by the pivot pin such that the blade is capable of pivoting between a folded "closed" position and an unfolded "open" position. A guide pin is also attached to the blade of the knife at the base. A spring is provided to exert a closing force on the blade when the blade is in the closed position and an opening force on the blade when the user moves the blade into a partially open position.

12 Claims, 10 Drawing Sheets

KNIFE WITH SPRING-ASSISTED BLADE ARTICULATION MECHANISM

CROSS-REFERENCES TO RELATED APPLICATIONS

This is a Continuation-in-part of U.S. patent application Ser. No. 10/745,793 filed Dec. 29, 2003, now abandoned and names the same inventor.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field folding knives. More specifically the present invention comprises a folding knife with a mechanism for assisting the articulation of the blade in and out of the pocket.

2. Description of the Related Art

Retractable knives, those knives that have blades that retract into the liner of the particular knife, come in a variety of shapes and sizes. Retractable knives fall into one of two broad categories. Some knives feature a blade which is retracted into and extended from its liner in a straight fashion. These knives are often referred to as stilettos. Stilettos utilize a spring to eject the blade from the liner when a button is pressed. Most jurisdictions prohibit the sale and possession of these types of knives.

A second type of retractable knife is the folding variety. These types of knives are commonly referred to as folding knives or pocket knives. Folding knives have blade which is pivotally connected to its liner at one end. The blade pivots between an unfolded position where the blade is extended out from the liner and a folded position where the blade rests within the pocket of the liner. Many folding knives are manual in that folding and unfolding of the blade is performed entirely by the user. Other folding knives are spring assisted where a spring assists in unfolding of the blade from the liner.

Spring assisted folding knives also come in different varieties. In one variety, the blade is held under a constant spring force while the blade is in the folded position within the pocket of the liner. The blade is held in place by some form of lock, typically some form of button. When the lock is released, the blade rapidly flips to the extended position by the action of the spring. Such knives, commonly called switchblades, are also illegal to sell and possess in many jurisdictions.

Another type of spring assisted folding knives utilizes a spring to assist in the unfolding operation after the user begins the unfolding process manually. The spring starts to assist the user once the user has partially unfolded the blade from the liner. The combined forces of the user and the spring work to fully unfold the blade into the open position.

While many different types of spring-assisted unfolding mechanisms are known, much less attention has been given to features which assist in the blade folding process. In addition, less attention has been given to features which keep the blade in the folded position. Such a feature requires some active force in order to fully fold the blade into its pocket in order to prevent the blade from accidentally unfolding in the user's pocket or onto the user's fingers.

It is therefore desirable to provide a spring-assisted folding mechanism that will assist the user in articulating the blade in and out of the pocket. It would also be desirable to provide a spring-assisted folding mechanism that helps retain the blade in the pocket. By helping keep the blade in the fully folded position, such systems help prevent the accidental partial unfolding of the blade and the attendant possibility for injury that can result from a blade being unexpectedly unfolded from its liner.

BRIEF SUMMARY OF THE INVENTION

The present invention comprises a knife with a spring-assisted articulation mechanism for assisting the user in the folding and unfolding of the blade from the pocket of the liner. The spring-assisted articulation mechanism also helps retain the blade in the folded position to prevent the blade from becoming unintentionally unfolded. The knife includes a pocketed liner and a blade attached to liner at one end of the liner by a pivot pin. The blade has a pointed end and a base end, the base end pivotally secured to the second end of the liner by the pivot pin such that the blade is capable of pivoting between a folded "closed" position and an unfolded "open" position. A guide pin is also attached to the blade of the knife at the base.

A spring arm is attached the liner and is used to supply a spring force to the guide pin. The spring arm is secured to the liner at its base, and has a free-moving tip and an apex near the tip. A cutout is provided in one side of the liner to permit movement of the spring arm. An arcuate slot is also provided in the side of the liner to permit the guide pin to project from the blade through the liner and travel radially about the pivot screw when the blade is articulated.

REFERENCE NUMERALS IN THE DRAWINGS

| | |
|---|---|
| 10 | folding knife |
| 12 | blade |
| 14 | liner |
| 16 | pocket |
| 18 | bolster |
| 20 | spring arm |
| 22 | apex |
| 24 | arm tip |
| 26 | pivot pin |
| 28 | guide pin |
| 30 | arm base |
| 32 | contact point |
| 34 | contact tangency line |

-continued

| | |
|---|---|
| 36 | contact-pivot line |
| 38 | arm cutout |
| 40 | arcuate slot |
| 42 | blade lock |
| 44 | pivot |
| 46 | lock base |
| 48 | lock tongue |
| 50 | blade cam |
| 52 | blade notch |
| 54 | spacer |
| 56 | spring arm slot |
| 58 | bore |
| 60 | toe |

DETAILED DESCRIPTION OF THE INVENTION

Figure 1:
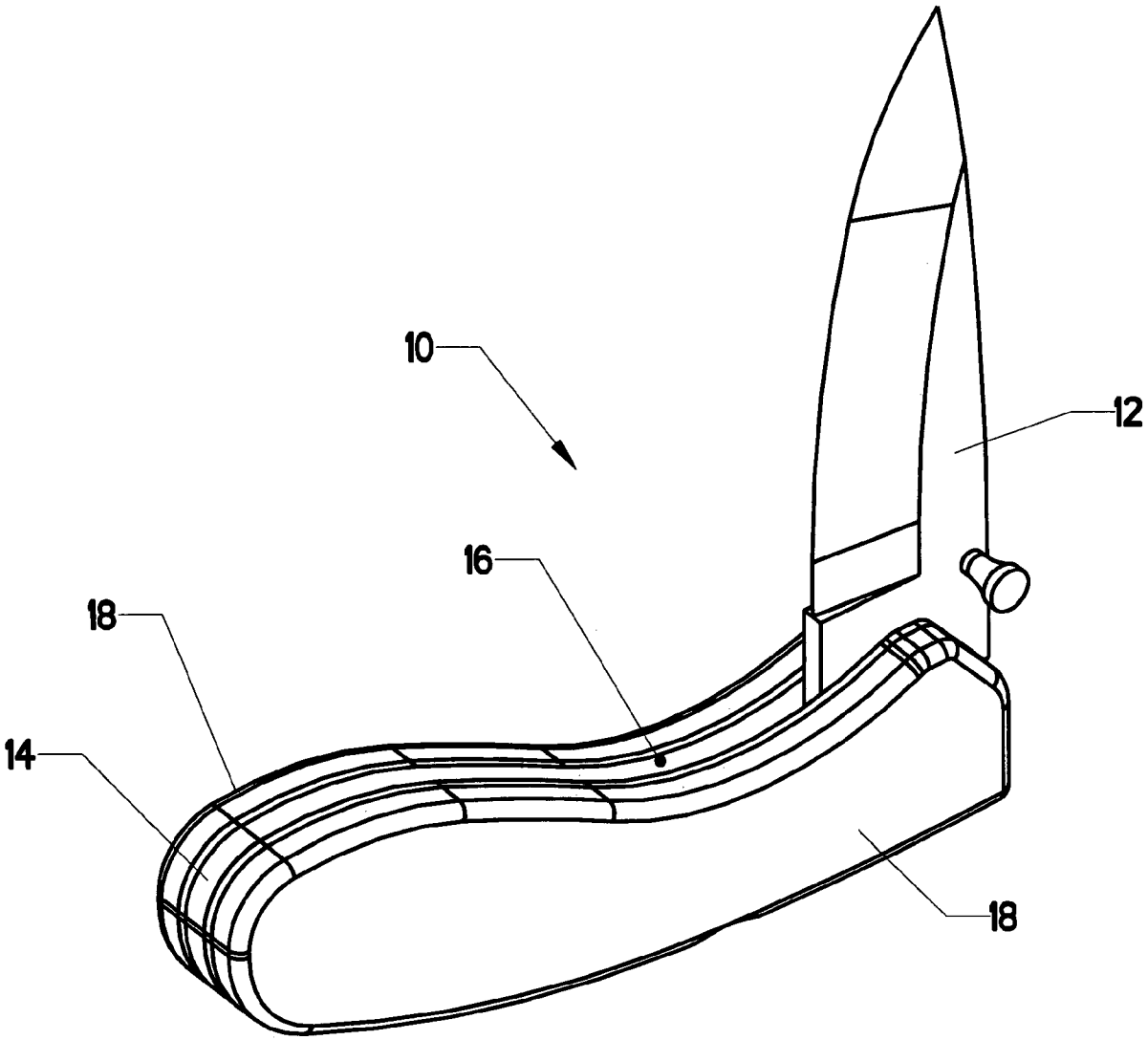
FIG. 1 is a perspective view, showing the present invention.

The present invention, folding knife 10 is illustrated in FIG. 1. Folding knife 10 includes blade 12 which articulates into and out of pocket 16 of liner 14. Blade 12 is pivotally attached to one end of liner 14 so that the cutting surface of blade 12 is contained within liner 14 when folding knife 10 is in the closed position. In the present illustration, folding knife 10 is shown in the partially open position. Folding knife 10 includes a locking mechanism which locks blade 12 in position when the user articulates the blade to the completely open position. Bolsters 18 are sandwiched around both sides of liner 14. Bolsters 18 facilitate gripping and hide moving parts of folding knife 10 which would otherwise be exposed through liner 14.

Figure 2:
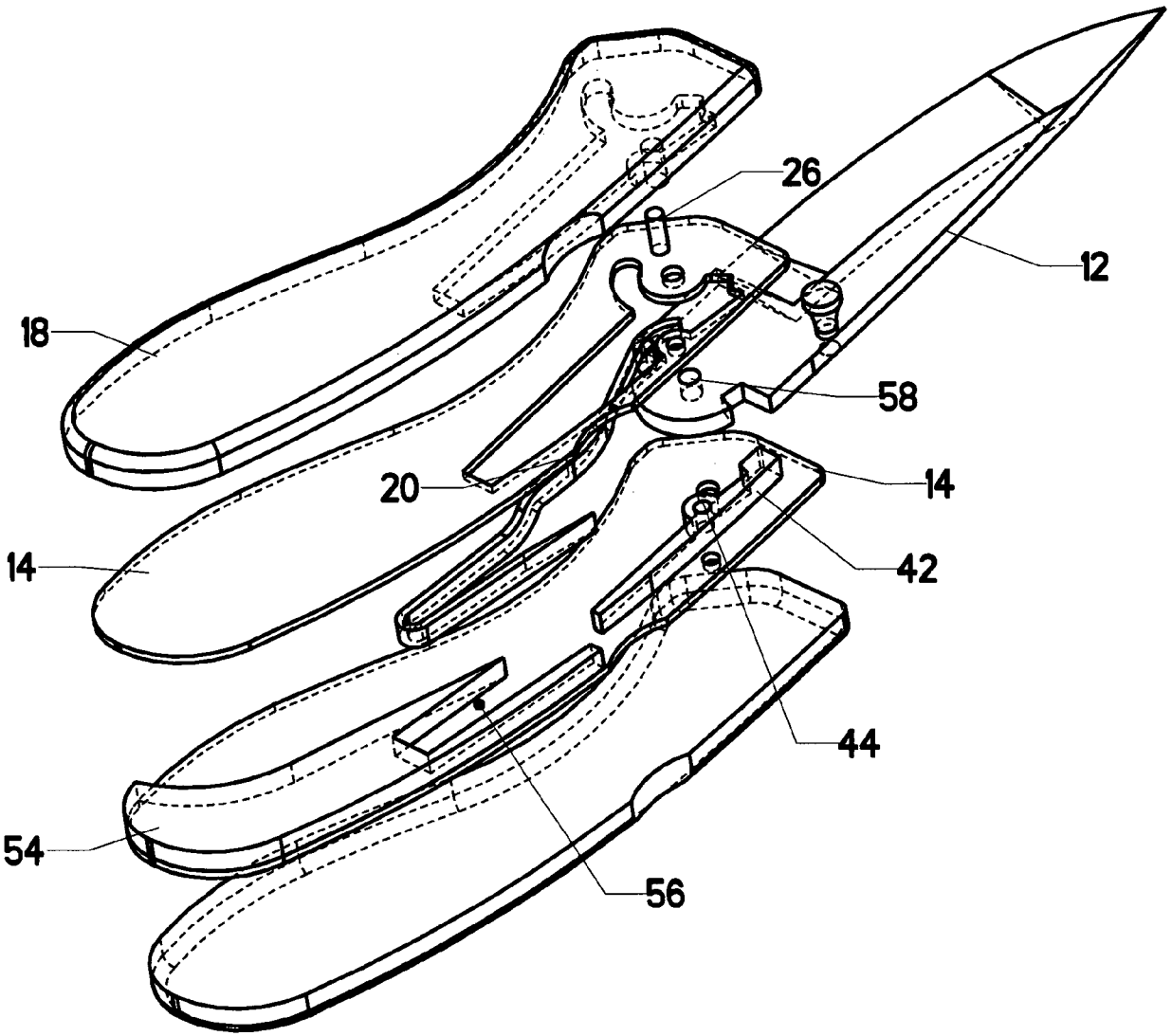
FIG. 2 is an exploded view, showing the present invention.

An exploded view of folding knife 10 is provided in FIG. 2. The exploded view illustrates the various parts of folding knife 10. Liner 14 is actually composed of three separate pieces—one corresponding to each side of liner 14, and spacer 54 positioned therebetween. When folding knife 10 is assembled spacer 54, blade 12, spring arm 20, and blade lock 42 are held in place by the side pieces of liner 14. In the assembled state, the base of spring arm 20 is captured thin spring arm slot 20 in spacer 54. Blade lock 42 is held in position by a pin placed through pivot 44. Blade 12 is held in position by pivot pin 26 which extends through both sides of the liner and bore 58 provided near the base of blade 12. Bolsters 18 are then attached around liner 14.

Figure 3A:
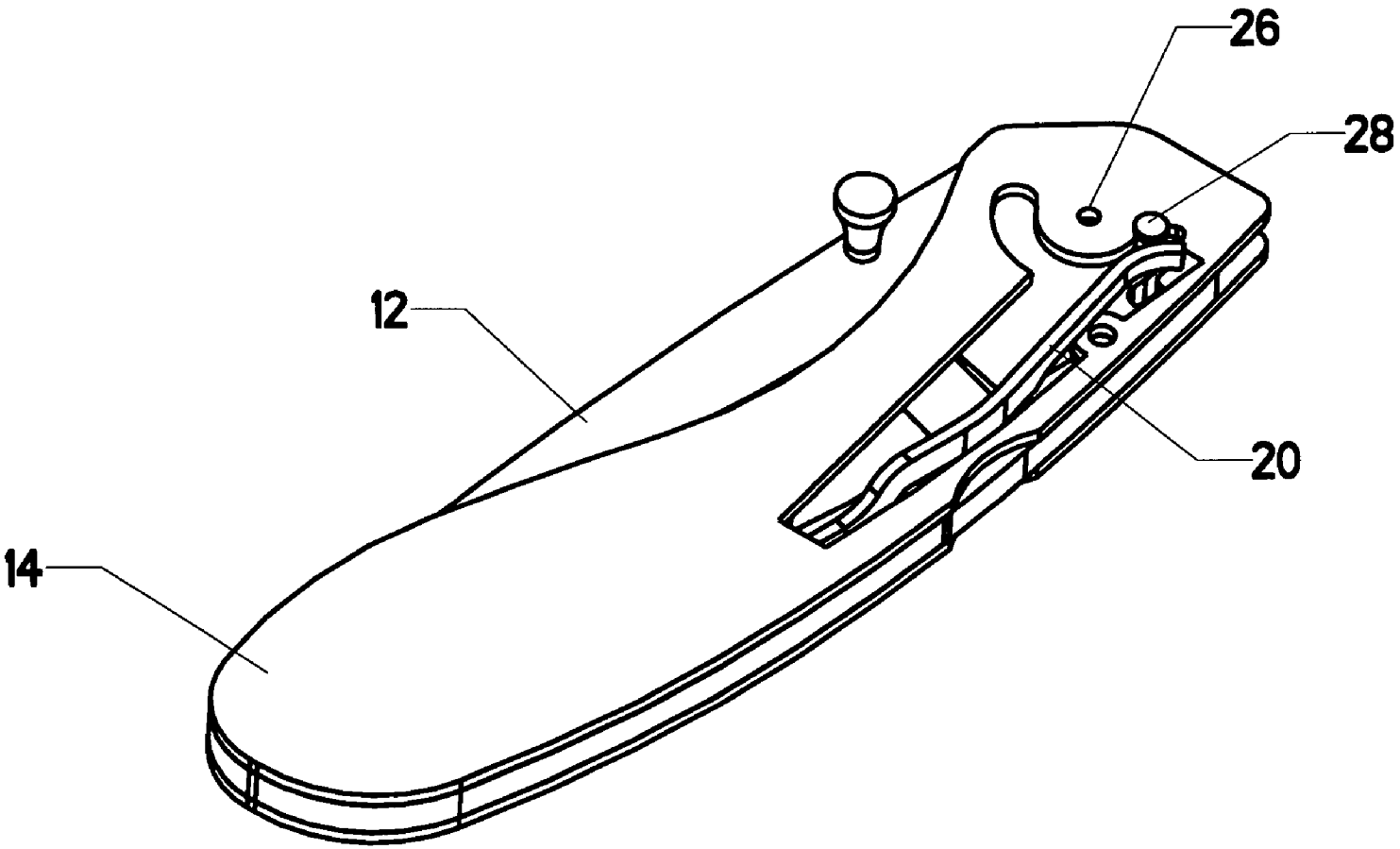
FIG. 3A is a perspective view, showing the present invention.

FIG. 3A shows folding knife 10 with blade 12 in the closed position and bolsters 18 removed. Blade 12 includes guide pin 28 positioned near the base of blade 12. Guide pin 28 is radially offset from pivot pin 26 so that guide pin 28 travels in a substantially circular path around pivot pin 26 when blade 12 is articulated. Spring arm 20 extends outside of liner 14 through a cutout in liner 14 and is shaped so that spring arm 20 bears against guide pin 28 near the tip of spring arm 20.

Figure 3B:
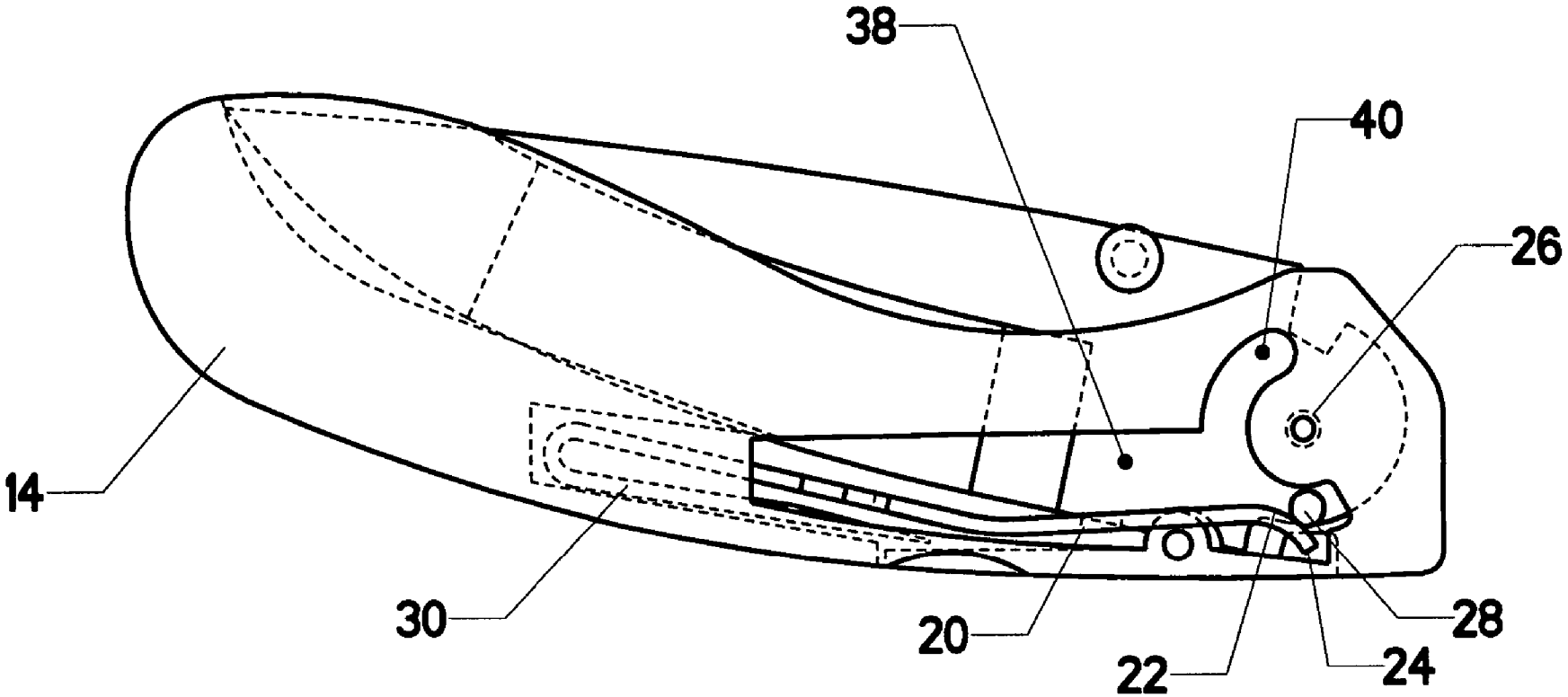
FIG. 3B is a detail view, showing the present invention.

As shown in FIG. 3B, spring arm 20 includes "U" shaped arm base 30 and apex 22 near arm tip 24. Apex 22 denotes the highest point along the curved surface of spring arm 20 when blade 12 is in the closed position in the perspective shown in the present view. The reader will note that the two sides of arm base 30 are compressed together slightly by when blade 12 is in the closed position. Spring arm 20 extends through arm cutout 38 in liner 14. Arm cutout 38 allows spring arm 20 to travel up and down during articulation of blade 12. Arcuate slot 40 is also provided in liner 14 so that guide pin 28 can extend through the liner and travel in a substantially circular path around pivot pin 26 during articulation of blade 12.

Figure 3C:
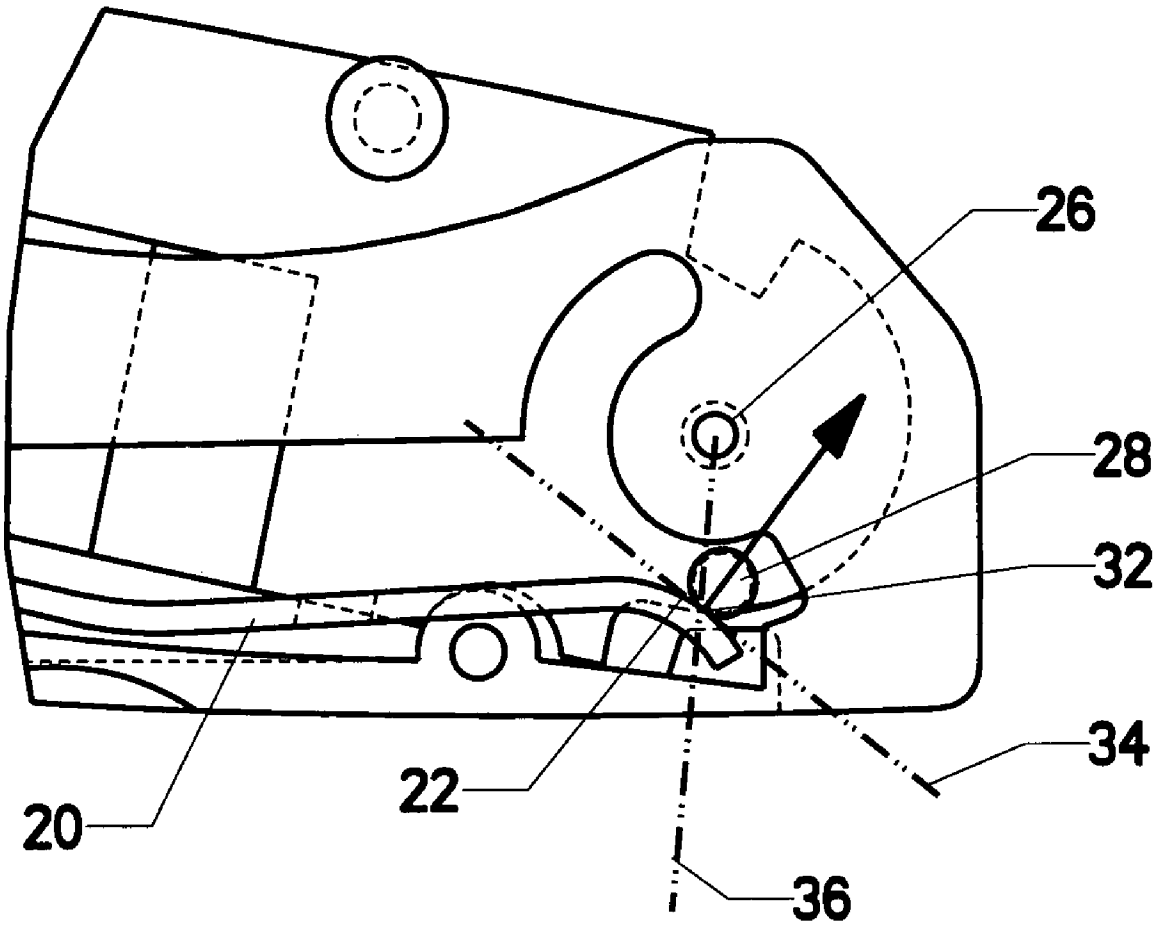
FIG. 3C is a detail view, showing the present invention.

As illustrated in by the arrow in FIG. 3C, spring arm 20 exerts a spring force on guide pin 28 at contact point 32. When blade 12 is in the closed position the spring force acts as a "closing force" or "closing torque" that tends to keep the blade in the closed position. Spring arm 20 has a curved surface facing guide pin 28. At contact point 32, the spring force exerted by spring arm 20 is normal to contact tangency line 34. Contact tangency line 32 is a line tangent to the surface of spring arm 20 at contact point 32. In order for spring arm 20 to provide a closing force when the blade is in the closed position, guide pin 28 is positioned at a location where spring arm 20 will interact with guide pin 28 in such a way that the spring force will counteract the articulation of the blade. Contact-pivot line 36 illustrates the relationship between contact point 32 and the center of rotation or pivot pin 26. The component of the spring force acting perpendicular to contact-pivot line 36 supplies the closing force.

Figure 4A:
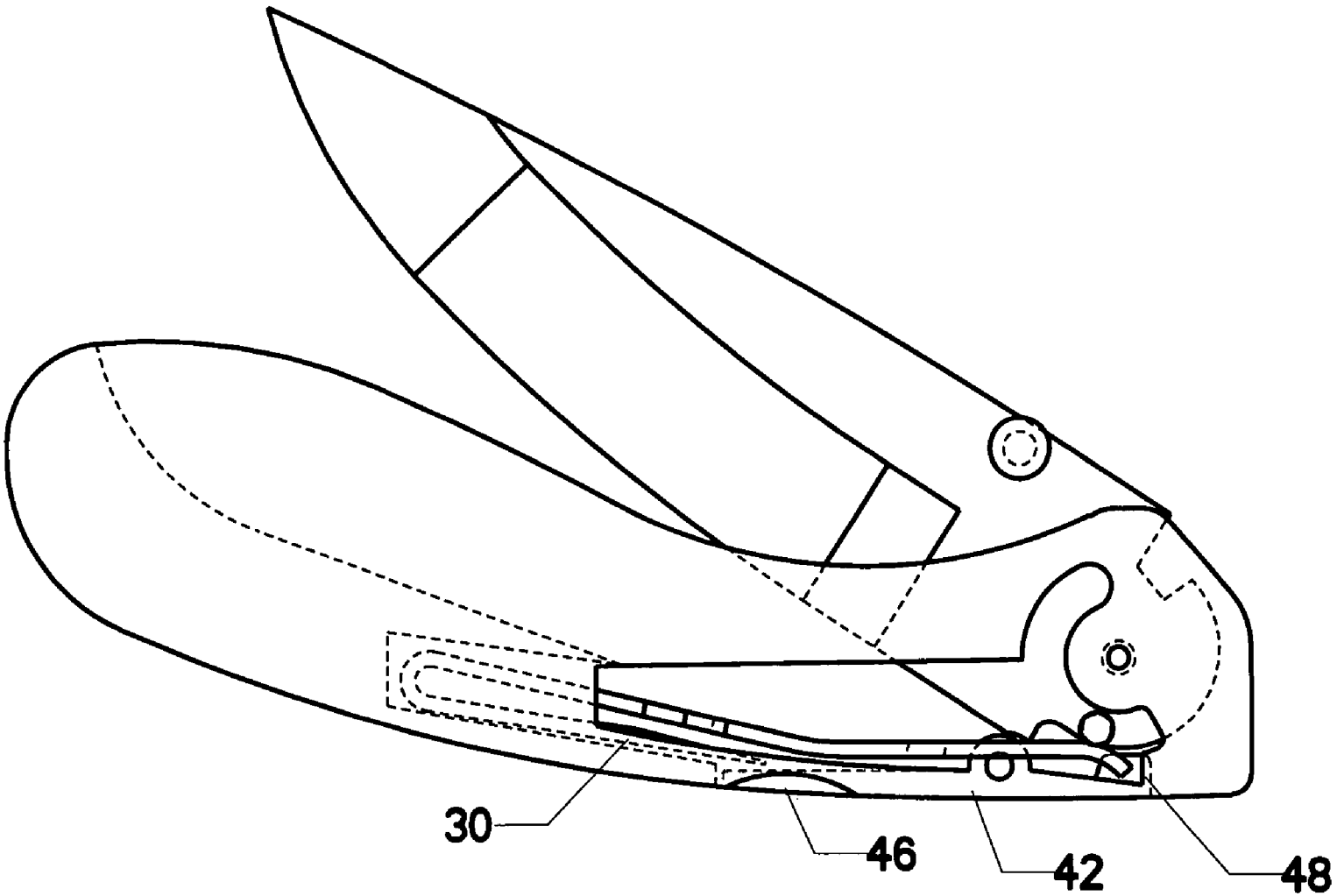
FIG. 4A is a detail view, showing the present invention.

FIG. 4A illustrates folding knife 10 with blade 12 in a partially open position. In this perspective, the reader will observe that blade lock 42 is in its normal position. Lock base 46 is positioned under arm base 30. Lock tongue 48 protrudes from blade lock 42 in the direction of the base of blade 12. When the blade is at this stage of articulation, lock tongue 48 is positioned near the base of blade 12 but is not actually touching the blade.

Figure 4B:
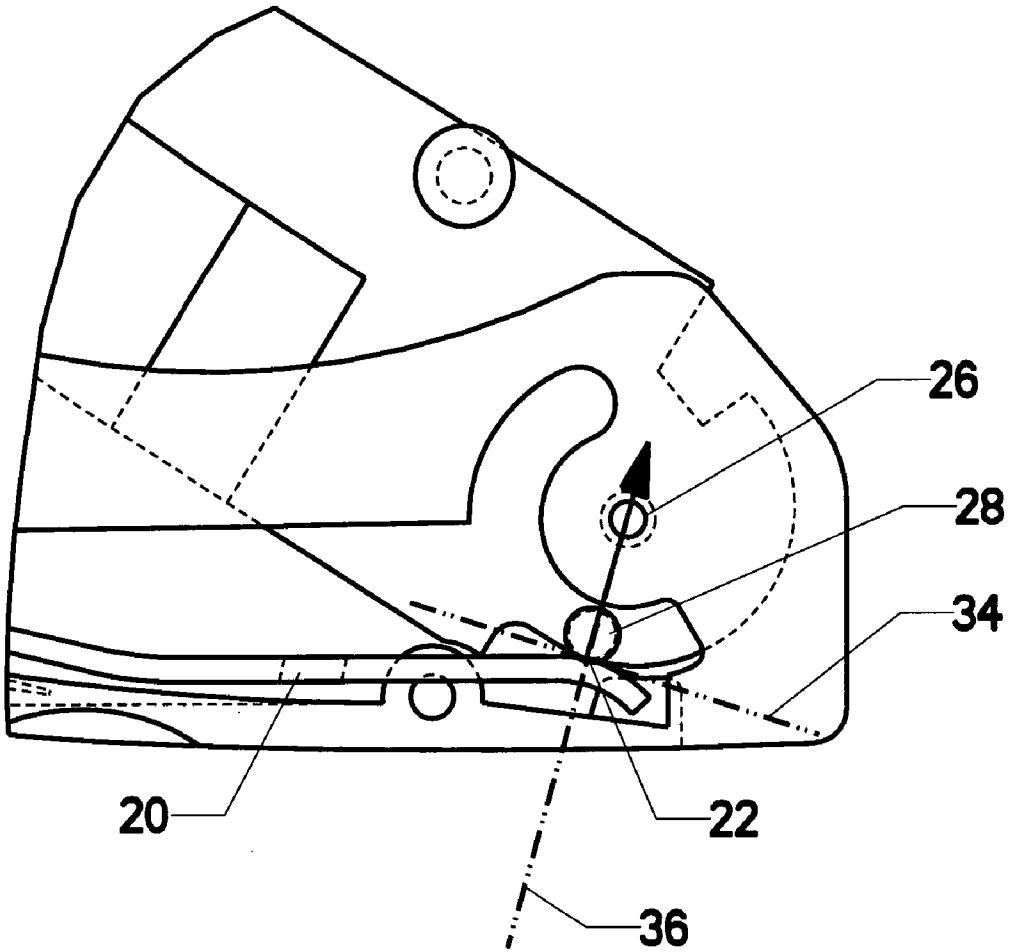
FIG. 4B is a detail view, showing the present invention.

FIG. 4B is a detailed view of folding knife 10 in the stage of articulation shown in FIG. 4A. The reader will note that guide pin 28 has traveled a small distance across the surface of spring arm 20 so that the contact point between guide pin 28 and spring arm 20 is near apex 22. At this stage of articulation contact tangency line 34 is perpendicular to contact-pivot line 36. As before, the arrow illustrates the spring force exerted by spring arm 20 on guide pin 28. At this stage of articulation, folding knife 10 has reached a balance or equilibrium point. Because the spring force is in the direction of contact-pivot line 36, there is no component of the spring force acting perpendicular to contact-pivot line 36. Accordingly, spring arm 20 exerts a neutral force since there is neither any closing force nor any opening force at this stage.

Figure 5:
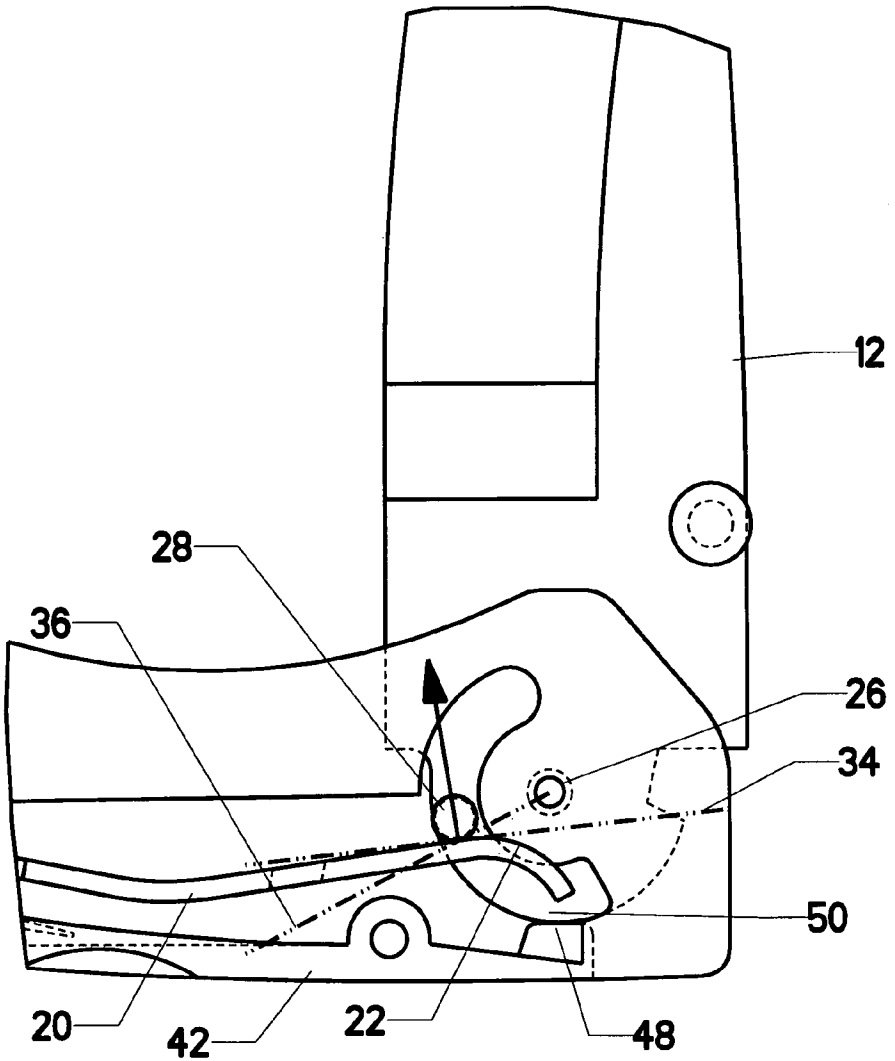
FIG. 5 is a detail view, showing the present invention.

FIG. 5 shows folding knife 10 when blade 12 is articulated past the equilibrium point shown in FIGS. 4A and 4B. Guide pin 28 has traveled further along the surface of spring arm 20 so that it passes over apex 22. Contact tangency line 34 and contact-pivot line 36 are also illustrated. The reader will note that the spring force (force exerted by the spring perpendicular to contact tangency line 34) supplies an opening force on blade 12 when folding knife 10 is in the present stage of articulation. Like the closing force, opening force is proportional to the component of the spring force acting perpendicular to contact-pivot line 36.

Blade cam 50 is provided at the base of blade 12. Because blade cam 50 has an increasing radius, blade cam 50 approaches lock tongue 48 as blade 12 is articulated and blade cam 50 rotates around pivot pin 26. In the present view, blade cam 50 is in contact with lock tongue 48 of blade lock 42. When folding knife 10 reaches this stage of articulation, blade lock 42 begins to provide frictional resistance to the articulation of blade 12.

Figure 6:
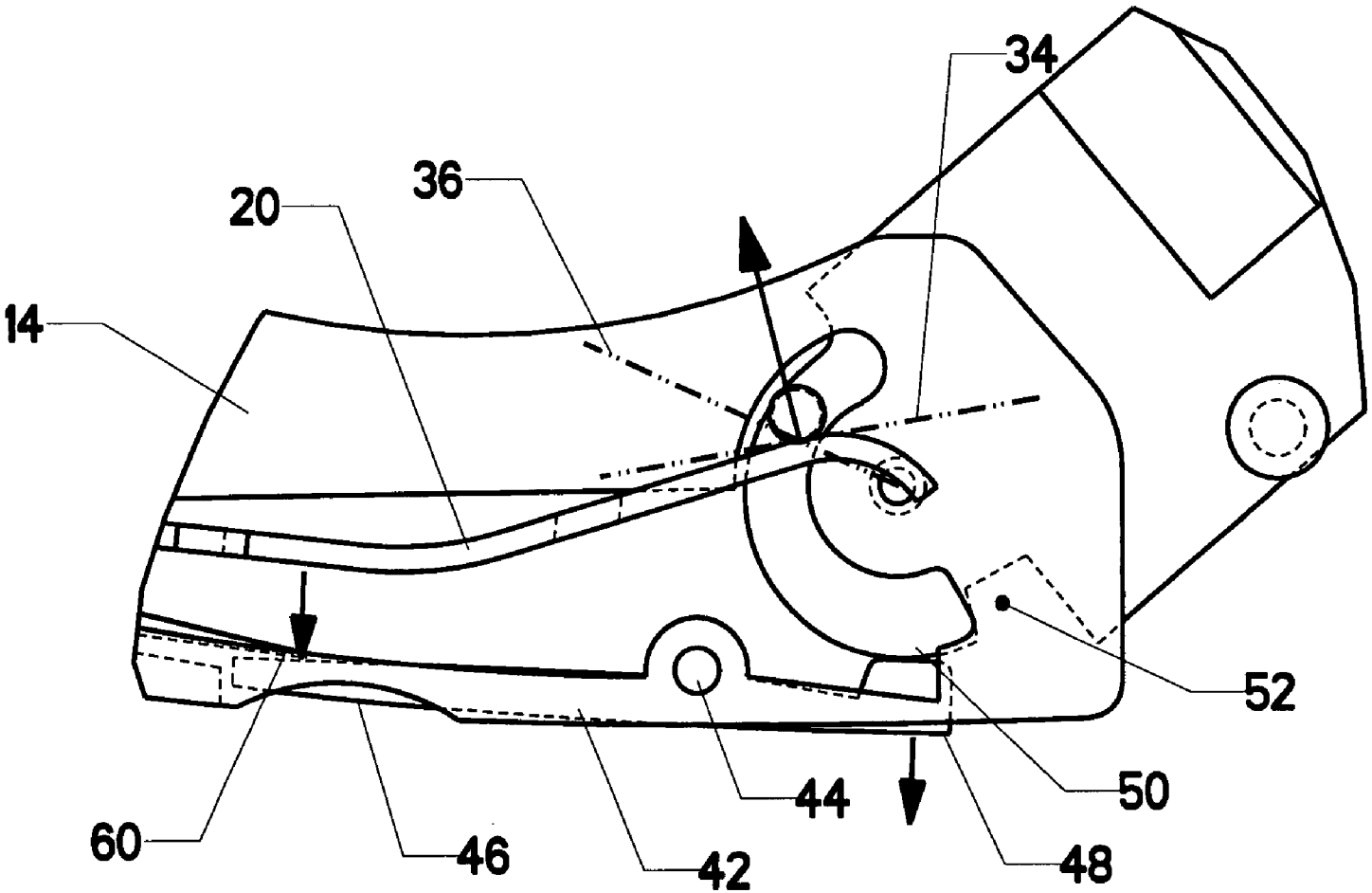
FIG. 6 is a detail view, showing the present invention.

FIG. 6 illustrates folding knife 10 when folding knife 10 reaches its second equilibrium stage during articulation of blade 12. Spring arm 20 continues to supply an opening force on blade 12, but the opening force supplied at this stage or articulation is less than the opening force supplied in the previous stage. The opening force is less than the previous stage because a greater portion of the spring force is exerted in the direction of contact-pivot line 36. Likewise, a smaller portion of the spring force is exerted in a direction perpendicular to contact-pivot line 36.

The second equilibrium stage is achieved when the force exerted by lock tongue 48 on blade cam 50 matches the opening force supplied by spring arm 20. As shown in FIG. 6, the increasing radius of blade cam 50 pushes lock tongue 48 out of the bottom of liner 14. This pushing force is illustrated by the arrow beneath lock tongue 48 in FIG. 6. Blade lock 42 is a lever and pivots around pivot 44. When blade lock 42 rotates around pivot 44 lock base 46 makes contact with toe 60 of arm base 30. Toe 60 supplies a force that acts to resist the rotation of blade lock 42 around pivot 44. Accordingly, the second equilibrium stage is achieved when the force supplied to toe 60 of the spring is sufficient to counteract the opening force supplied by spring arm 20.

Figure 7:
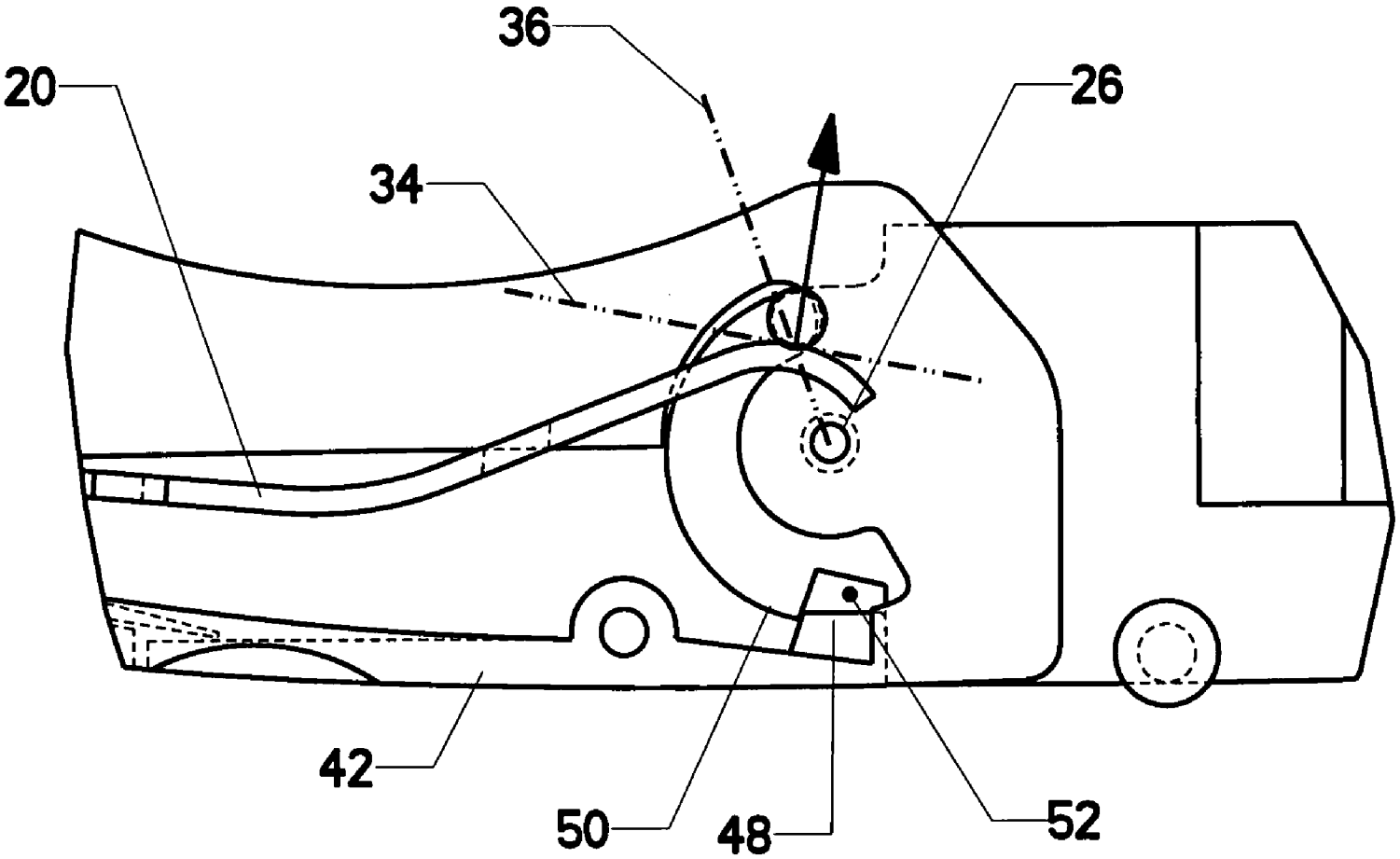
FIG. 7 is a detail view, showing the present invention.

Folding knife 10 is shown in its completely open stage in FIG. 7. The reader will note that to articulate folding knife from its second equilibrium stage to the present stage, the user must provide additional opening force on the knife. This can be accomplished in a couple of ways. First, the user may simply grab the non cutting edge side of blade 12 and rotate blade 12 around pivot pin 26 until it locks. Alternatively, the user may press lock base 46 against toe 60, so that the opening force supplied by spring arm 20 causes blade 12 to rotate around pivot pin 26 until it locks. The blade locks in place as lock tongue 48 inserts into blade notch 52 at the base of blade 12. Because the user must supply the opening force to completely open the blade, the proposed invention cannot be classified as a switchblade and avoids the prohibitions and restrictions placed on such knives.

The preceding description contains significant detail regarding the novel aspects of the present invention. It should not be construed, however, as limiting the scope of the invention but rather as providing illustrations of the preferred embodiments of the invention. As an example, it is not necessary that the same spring be used to supply spring force to guide pin 28 and blade lock 42. Instead, a separate spring may also be provided to engage the base of blade lock 42. Such variations would not alter the function of the invention. Thus, the scope of the invention should be fixed by the following claims, rather than by the examples given.

Having described my invention, I claim:

1. A folding knife comprising:

a. a liner having a first side, a second side, an open top leading to a pocket, a bottom, a first end, a second end, and a medial section therebetween;

b. a blade having a pointed end and a base end, said base end pivotally secured to said second end of the liner such that said blade is capable of pivoting between a closed position wherein said blade is received within said pocket and an open position wherein said blade pivots out of said pocket through said open top and extends outwardly from said second end of the liner;

c. a guide pin projecting outward from said base end of said blade and through said first side of said liner;

d. a spring arm having a base, a tip, a top surface facing in the direction of said open top of said liner, and an apex in said top surface proximal said tip; said spring arm secured to said liner by said base of said spring arm and said tip extending toward said second end of said liner; said spring arm positioned between said bottom of said pocket and said guide pin on said blade;

e. a blade lock having a first end, a second end, a medial section therebetween, and a tongue proximal said first end of said blade lock protruding towards said open top of said liner; said blade lock secured to said liner proximal said bottom of said liner by a pivot joint between said first end and said second end of said blade lock;

f. wherein said spring arm supplies a closing force on said guide pin when said blade is in said closed position, said closing force resisting the articulation of said blade from said closed position to said open position;

g. wherein said spring arm supplies an opening force on said guide pin after said blade passes a first equilibrium position during articulation of said blade from said closed position to said open position, said opening force assisting the articulation of said blade from said first equilibrium position to said open position; and h. wherein said blade lock exerts a resisting force opposing articulation of said blade to a completely open position, such that a second equilibrium position is achieved before said blade is articulated to said completely open position.

2. The folding knife of claim 1, wherein during articulation of said blade from said closed position to said open position, said guide pin engages said spring arm between said tip and said apex and upon articulation of said blade from said closed position to said open position, said guide pin passes over said apex.

3. The folding knife of claim 1, said blade further comprising a cam proximal said base end of said blade, said cam configured to engage said tongue of said blade lock as said blade is articulated from said closed position to said open position.

4. The folding knife of claim 3, said spring arm further comprising a toe proximal said base of said spring arm, said toe configured to provide resistive force against said second end of said blade lock so that said tongue of said blade lock bears against said cam and resists said opening force supplied by said spring arm.

5. The folding knife of claim 1, said spring arm further comprising a toe proximal said base of said spring arm, said toe configured to engage said second end of said blade lock rotates around said pivot joint.

6. The folding knife of claim 1, said top surface of said spring arm having a convex profile facing said open top of said liner at said apex.

7. A folding knife having an assistive opening and closing mechanism for assisting a user in opening and closing said folding knife, said folding knife comprising:

a. a liner having a first side, a second side, an open top leading to a pocket, a bottom, a first end, a second end, and a medial section therebetween;

b. a blade having a pointed end and a base end, said base end pivotally secured to said second end of the liner such that said blade is capable of pivoting between a closed position wherein said blade is received within said pocket and an open position wherein said blade pivots out of said pocket through said open top and extends outwardly from said second end of the liner;

c. a guide pin projecting outward from said base end of said blade and through said first side of said liner;

d. a spring arm, said spring arm secured to said liner and configured to engage said guide pin;

e. a blade lock having a first end, a second end, a medial section therebetween; said blade lock secured to said liner proximal said bottom of said liner;

f. wherein during articulation of said blade from said closed position to said open position said folding knife passes through a plurality of stages including i. a closed stage, wherein said spring arm exerts a closing force on said blade, said closing force resisting articulation of said blade from said closed position to said open position;

ii. a partially open stage, wherein said spring arm exerts an opening force on said blade, said opening force assisting articulation of said blade from said closed position to said open position;

iii. a first equilibrium stage occurring between said closed stage and said partially open stage during articulation of said blade from said closed position to said open position; wherein said spring arm exerts a neutral force;

iv. a second equilibrium stage occurring after said partially open stage and before said blade is fully articulated to a completely open stage; wherein said opening force exerted by said spring arm is counteracted by a resistive force exerted on said blade by said blade lock causing said blade to remain only partially open until said user exerts an additional opening force on said folding knife.

8. The folding knife of claim 7, said blade lock further comprising a tongue proximal said first end of said blade lock protruding towards said open top of said liner.

9. The folding knife of claim 8, said blade further comprising a cam proximal said base end of said blade, said cam configured to engage said tongue of said blade lock as said blade is articulated from said closed position to said open position.

10. The folding knife of claim 9, said spring arm further comprising a toe proximal said base of said spring arm, said toe configured to provide resistive force against said second end of said blade lock so that said tongue of said blade lock bears against said cam and resists said opening force supplied by said spring arm.

11. The folding knife of claim 7, said spring arm further comprising a toe proximal said base of said spring arm, said toe configured to engage said second end of said blade lock rotates around said pivot joint.

12. The folding knife of claim 7, said spring arm having a top surface facing said open top of said liner, said top surface having a convex profile facing said open top of said liner.

* * * * *